United States Patent [19]

Marlow et al.

[11] Patent Number: 4,867,077

[45] Date of Patent: Sep. 19, 1989

[54] REACTIVE ARMOR CONSTRUCTIONS AND EXPLOSIVE PACKAGES SUITABLE THEREFOR

[75] Inventors: Peter G. Marlow, Harrogate; Mario L. Granelli, Leeds; Melvyn Perry, Wetherby, all of England

[73] Assignee: Royal Ordnance plc, London, England

[21] Appl. No.: 130,275

[22] Filed: Dec. 8, 1987

[51] Int. Cl.[4] ..... F41H 5/04

[52] U.S. Cl. ..... 109/36; 109/82; 89/36.17

[58] Field of Search ..... 109/36, 37, 84, 82, 109/80; 89/36.17, 36.02, 36.08

[56] References Cited

U.S. PATENT DOCUMENTS

| | | | |
|---|---|---|---|
| 4,360,660 | 1/1983 | Held | 109/36 |
| 4,398,446 | 8/1983 | Pagano | 89/36.17 |
| 4,741,224 | 5/1988 | Ratner | 109/36 |

FOREIGN PATENT DOCUMENTS 1547528 6/1979 United Kingdom .

*Primary Examiner*—Robert L. Wolfe

*Attorney, Agent, or Firm*—Stevens, Davis, Miller & Mosher

[57] ABSTRACT

An explosive package for use in reactive armor comprises an explosive material embedded between layers of a resilient material which are contained between upper and lower rigid plates in a sandwich structure. A construction for the application of reactive armor to a structure to be protected comprises a plurality of such packages, a plurality of projections attached to the said structure and a plurality of holders each attachable to and thereby running between adjacent projections, each of the holders in use holding an edge of one of the said packages, each projection thereby being attached to at least one of the said packages by the holder attached thereto.

12 Claims, 2 Drawing Sheets

REACTIVE ARMOR CONSTRUCTIONS AND EXPLOSIVE PACKAGES SUITABLE THEREFOR

The present invention relates to reactive armour constructions and explosive packages suitable therefor.

Reactive armour comprises a protective construction including an explosive material which reacts to the impact of a projectile, especially one comprising a shaped charge warhead. The impact causes detonation of the explosive material of the armour which serves to reduce the penetrative effect of the shaped charge. The principle of reactive armour is further described in UK Patent No. 1,581,125 and U.S. Pat. No. 4,368,660.

European Patent Application No. 0,161,390A1 describes the use of an armour construction comprising an arrangement of reactive armour sections which may be added individually to predetermined location points on the outer surface of a military tank or other structure to be protected to provide an additional barrier layer around the outer surface. The boundaries between sections inhibit section-to-section detonation. Unfortunately, an armour construction formed from such sections suffers from the problem that the sections need to be small enough to minimise the possibility of multiple projectile hits yet large enough to ensure that the spacing between sections does not constitute a significant fraction of the surface area to be protected in order to minimise the vulnerability of the underlying regions.

According to a first aspect of the invention there is provided an explosive package for use in a reactive armour construction which package comprises an explosive material embedded between layers of a resilient material which are contained between upper and lower rigid plates in a sandwich structure.

Preferably the explosive material is contained in a waterproof jacket embedded between the layers of resilient material.

The plates may conveniently have an internal locating rib structure to locate the explosive material embedded between the resilient material.

The explosive material is advantageously a plastic bonded explosive material.

According to a second aspect of the invention there is provided a reactive armour construction comprising a plurality of explosive packages each in accordance with the invention.

The construction may comprise a plurality of charges of explosive material each in accordance with the inveniton, a plurality of projections attached in use ot the said structure and a plurality of holders each attachable to and thereby running between adjacent projections, each of the holders in use holding an edge of one of the said packages, each projection thereby being attached to at least one of the said packages by the holder attached thereto.

Preferably, projections between a plurality of adjacent packages are attached to the holders of each of those packages. For example, the packages may be arranged in a row and column matrix with projections attached commonly to the holders adjacent to the corners of the packages.

We have found that the construction of reactive armour according to the present invention provides a relatively simnple and inexpensive way of applying reactive armour to the structure to be protected. As compared with known constructions, explosive packages in the construction according to the invention may be more easily removed and replaced. The construction also enables greater areas of the underlying structure to be protected by the use of larger area explosive packages which may be placed closer together and it can also reduce the risk of sympathetic detonation between adjacent packages because the holders can be designed to reduce the risk of such detonation.

Each of the projection smay for example comprise a boss which may have an upper plate attached thereto to which the appropriate holder of holders are attached.

Each of the said packages may for example comprise a sandwich in which an explosive charge is contained between plates or layers of inert material. Preferably the inert material overlaps the explosive package at the edges of the package whereby the holders contain only the overlapped inert material not the explosive material.

A common attachment may be used to secure the ends of adjacent holders meeting at the corner of a given package, as well as the overlapping ienrt material at that corner to the appropriate projection, e.g. a plate attached to a boss. For example, the common attachment may comprise a screw joint at the corner of the package holding the adjoining holders and the inert material of the package together and to the projection.

The holders mahy for example comprise edging strips having an approximate C-shape or U-shape in cross-section, the edges of the inert material of the packages being retained as an insert between the limbs of the C or U of the strip. The strips may for example be made of steel or other metal. Preferably, strips adjoining at the corner of a given package have end portions such that one fits one inside the other at the angle made by the package corner to facilitate attaching the strips together as described above. This may be achieved by providing one ofthe adjoining strips with an end portion of which the limbs of the C or U are closer together than in the main part of the strip.

Adjacent strips may be attached together in other ways, e.g. by providing ends at an angle of 45° to the edges of the strip sides which mate together in the same manner as in the corner of a picture frame.

The explosive package according to the present invention may comprise an explosive material encapsulated within a resilient package, e.g. comprising a soft rubber or elastomeric material. For example the explosive material may be contained in a waterproof jacket eg. a plastic bag embedded between layers of a resilient material.

The plates of the explosive package may be made of metal. One or both of these layers may, alternatively, comprise a composite layer incorporating any of the materials known for use incomposite engineering structures.

For example in a simple form a composite material may comprise high strength fibres or fabrics embedded within a suitable matrix. Suitable examples of high strength fibres well known in the composites art are those of aramid, polyamide, polyolefin, carbon, boron, glass and metal. Suitable high strength fabrics are well known in the composites art and are generally formed of woven fibres, for example any of the aforementioned fibres or blends or mixtures of them. Composites containing aramid fibres or fabrics are especially preferred.

The matrix in which the fibres or fabrics are preferably embedded may comprise a polymeric material or an inorganic, e.g. metal or ceramic mateiral. Especially preferred is a laminate structure comprising alternate layers of a high strength fabric and a ceramic. The fabric mah be bonded to the cermaic by any suitable adhesive as used in the composites art for the bonding of fabrics to ceramics. the laminate may be formed as one or more sandwiches of a fabric between ceramic layers or, preferably, as one or more sandwiches of a ceramic between fabric layers. Where multiple sandwiches are employed individual layers may be common to adjacent sandwiches.

A preferred composite lyaer comprises a laminate comprising at least one aramid fabric sub-layer and at least one ceramic sub-layer, e.g. alumina, silicon carbide or boron carbide. Such laminates are known per se, e.g. as described in UK Patent Applications No. GB 2,156,272A and 2,130,073A. The aramid fabric may be bonded to the ceramic by any suitable known adhesive or bonding agent, which may for example be a cold setting, thermosetting or thermoplastic material, known to be suitable for bonding aramid to ceramic.

For example, known liquid or powder adhesive may be used to bond together the fabric to the ceramic. The bonding may be by 'wet-lay-up' or the layers may be in prepreg form with the adhesive activated by heat and/or other means. Contact adhesive or hot melt adhesive may be used. If desired, the adhesive may be of synthetic resin type, for example, polyester or epoxy resins. The adhesive may also be of a rubber material, for example silicone rubber. If desired the superposed layers may be subjected to pressure during bonding.

composite layers as described may be used in conjunction with one or more metallic, e.g. armour steel, layers to form overall the otuer and/or inner layer described above.

The explosive material is preferably a material of the plastic bonded explosives type.

Embodiments of the present invention will now be described by way of example with reference to the accompanying drawings, in which.

Figure 1:
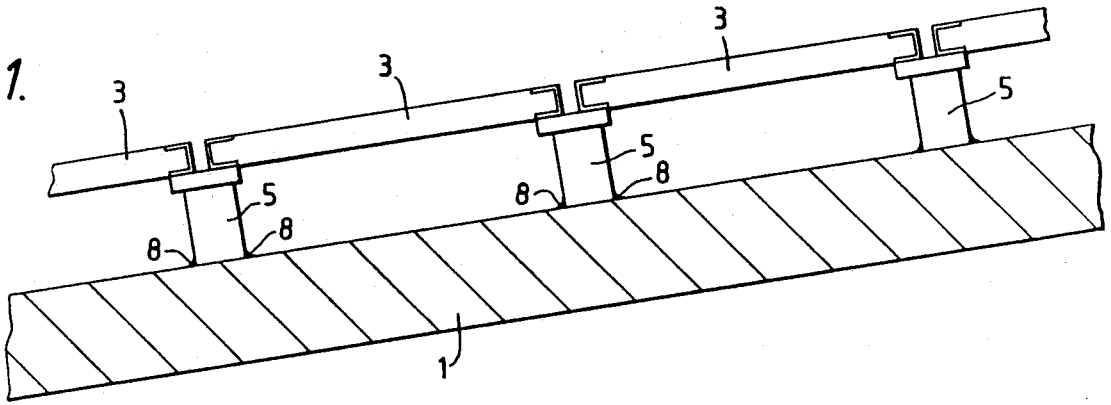
FIG. 1 is a cross-sectional side elevation of a construction embodying the present invention.
Figure 2:
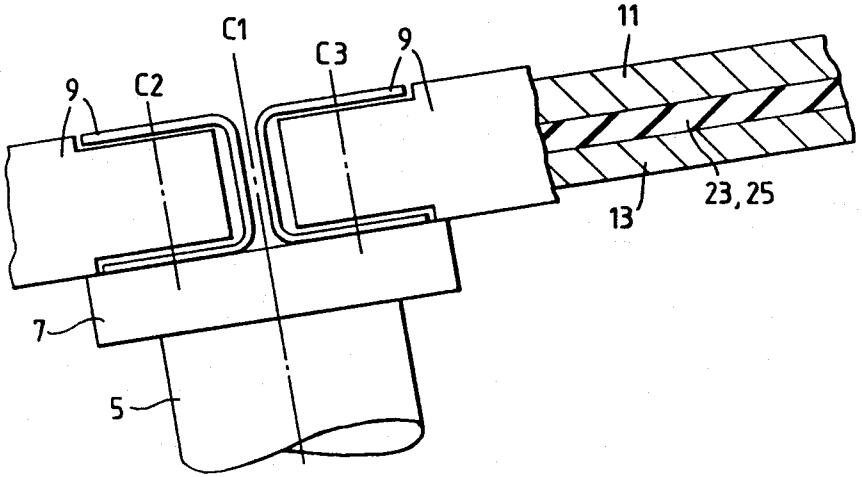
FIG. 2 is an enlarged view of part of the construction shown in FIG. 1.

In FIGS. 1 and 2 the glacis 1 of an armoured fighting vehicle is protected by a reactive armour construction comprising a matrix array of explosive panels or packages 3 mounted on the glacis 1 by bosses 5 welded to the glacis 1 at welds 8.

Each of the bosses 5 has attached thereto by a screw (not shown) on the centre line C1 a top plate 7 to which are respectively attached by screws (not shown) on the centre lines C2 and C3 C-section edging strips 9 in which the edges of the packages 3 are fitted and attached at their corners by the screws (not shown) attaching the strips 9 to the plates 7.

Figure 3:
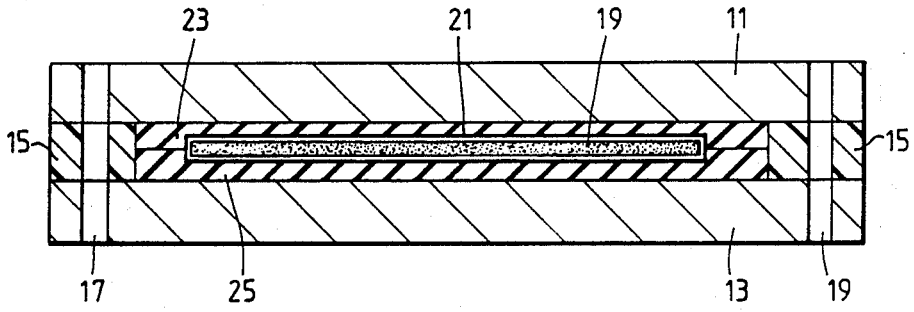
FIG. 3 is a cross-sectional side elevation of an explosive package which may be used in the construction shown in FIG. 1.

FIG. 3 shows one form of the explosive packages 3 which may be used in the construction shown in FIGS. 1 and 2. A steel plate 11 and a steel plate 13 form the respective outer layers of a sandwich comprising as its inner portion a charge 19 of explosive material contained within a waterproof plastics liner 21 which in turn is contained between a silicone rubber layer 23 and a silicone rubber layer 25. An edging frame 15 (which may be formed as a single unit or from component strips) made of polypropylene is provided to restrain lateral movement of the charge 19. Holes 17 and 19 (and corresponding holes in the other corners of the package not shown in FIG. 3) are provided through the plates 11 and 13 and the frame 15 to enable the package ot be attached by screws to the bosses 5 in the manner described above with reference to Figures 1 and 2.

In an alternative embodiment one or both of the plates 11, 13 may be replaced by or added to one of the composite structures described above.

In operation, if one of the charges 19 is detonated by the impact of an incoming projectile the plates 11 and 13 are caused to separate explosively away from one another thereby disrupting the penetrative effect of the projectiles in a known way. The space between the packages 3 and the underlying glacis 1 (the so-called 'stand-off' distance) allows the plate 13 to move toward the glacis 1 in the manner described in EPO,161,390A1.

The construction described with reference to FIGS. 1 and 2 conveniently allows explosive packages to be arranged and located adjacnet to one another in such a way that a suitable spacing may be maintained between adjacent explsovie charges to avoid the problem of sympathetic detonation.

We claim:

1. An explosive package for use in a reactive armor construction, said package comprising an explosive material embedded between layers of a resilient material, said layers of resilient material being contained between upper and lower rigid plates in a sandwich structure and wherein said rigid plates extend beyond end edges of said layers of resilient material to provide end space between said upper and lower rigid plates adjacent end edges thereof, said end spaces accommodating a locating rib structure to restrain lateral movement of said explosive material, and attachment means provided by said upper and lower rigid plates and by said locating rib structure to facilitate attachment of said explosive package to a structure to be protected thereby.

2. A package as claimed in claim 1 and wherein the explosive material is contained in a waterproof jacket embedded between the layers of resilient material.

3. A package as claimed in claim 1 and wherein the explosive material is a plastic obnded explosive material.

4. A reactive armour construction comprising a plurality of explosive packages each being a package as claimed in claim 1 wherein the packages are arranged to protect a structure.

5. A reactive armour construction as claimed in claim 4 and wherein the construction comprises a plurality of packages of explosive material each as claimed in claim 1, a plurality of projections attached in use to the structure to be protected and a plurality of holders each attachable to and thereby running between adjacent projections, each of the holders in use holding an edge of one of the said packages, each projection thereby being attached to at least one of the said packages by the holder attached thereto.

6. A reactive armour construction as claimed in claim 5 and wherein projections betweem a plurality of adjacent packages are attached to the holders or each of those packages, the packages being arranged in a row and column matrix with projections attached commonly to the holders adjacent to the corners of the packages.

7. A construction as claimed in claim 5 and wherein each of the projections comprises a boss which has an upper plate attached thereto to which the appropriate holder or holders are attached.

8. A construction as claimed in claim 5 and wherein a common attachment secures the ends of adjacent holders meeting at the corner of a given package, as well as overlapping inert material at that corner to the appropriate projection.

9. A construction as claimed in claim 8 and wherein each common attachment comprises a screw joint at the corner of the package holding the adjoining holders and the inert material of the package together and to the projection.

10. A construction as claimed in claim 9 and wherein the holders comprise edging strips having an approximate C-shape or U-shape in cross-section, the edges of the inert material of the package being retained as an insert between the limbs of the C or U or the strip.

11. A construction as claimed in claim 10 and wherein the strips adjoining at the corner of a given package have end portions such that one fits one inside the other at the angle made by the package corner to facilitate attaching the strips together as described above.

12. A construction as claimed in claim 11 and wherein one of each pair of adjoining strips has an end portion in which the limbs of the C or U are closer together than in the main part of the strip.

* * * * *